United States Patent [19]

Kerr et al.

[11] 4,280,413

[45] Jul. 28, 1981

[54] CONVEYOR SYSTEM

[75] Inventors: Douglas M. Kerr; Thomas L. Crandall; Daniel J. Scalf, all of Fairfield, Iowa

[73] Assignee: Acco Industries Inc., Trumbull, Conn.

[21] Appl. No.: 40,541

[22] Filed: May 21, 1979

[51] Int. Cl.[3] ..... B61B 3/02; B61G 5/00; B61G 7/12

[52] U.S. Cl. ..... 105/150; 213/1 R; 213/75 R; 414/752

[58] Field of Search ..... 414/752; 104/93; 105/150, 148; 213/1, 75 R, 75 D

[56] References Cited

U.S. PATENT DOCUMENTS

| | | | |
|---|---|---|---|
| 1,802,550 | 4/1931 | Bennington | 104/93 X |
| 3,450,271 | 6/1969 | Bissett | 213/75 D |
| 3,960,276 | 6/1976 | Gerhardt | 414/752 X |

FOREIGN PATENT DOCUMENTS

| | | | |
|---|---|---|---|
| 392362 | 11/1908 | France | 104/93 |

*Primary Examiner*—Charles A. Marmor

*Attorney, Agent, or Firm*—Barnes, Kisselle, Raisch & Choate

[57] ABSTRACT

A conveyor system comprising a motor power unit, a load carrier and a track along which the motor power unit and the load carrier can move. A vacuum pad is mounted on the motor power unit and extends rearwardly and a vacuum power unit is mounted on said motor power unit for applying vacuum to the vacuum pad. A plate is mounted on and extends forwardly of the load carrier and is adapted to be engaged by the vacuum pad whereby when the vacuum pad engages the plate and is activated a coupling is provided between the motor power unit and said load carrier so that the motor power unit will move the load carrier along the track in either direction.

9 Claims, 6 Drawing Figures

FIG.6
FIG.4
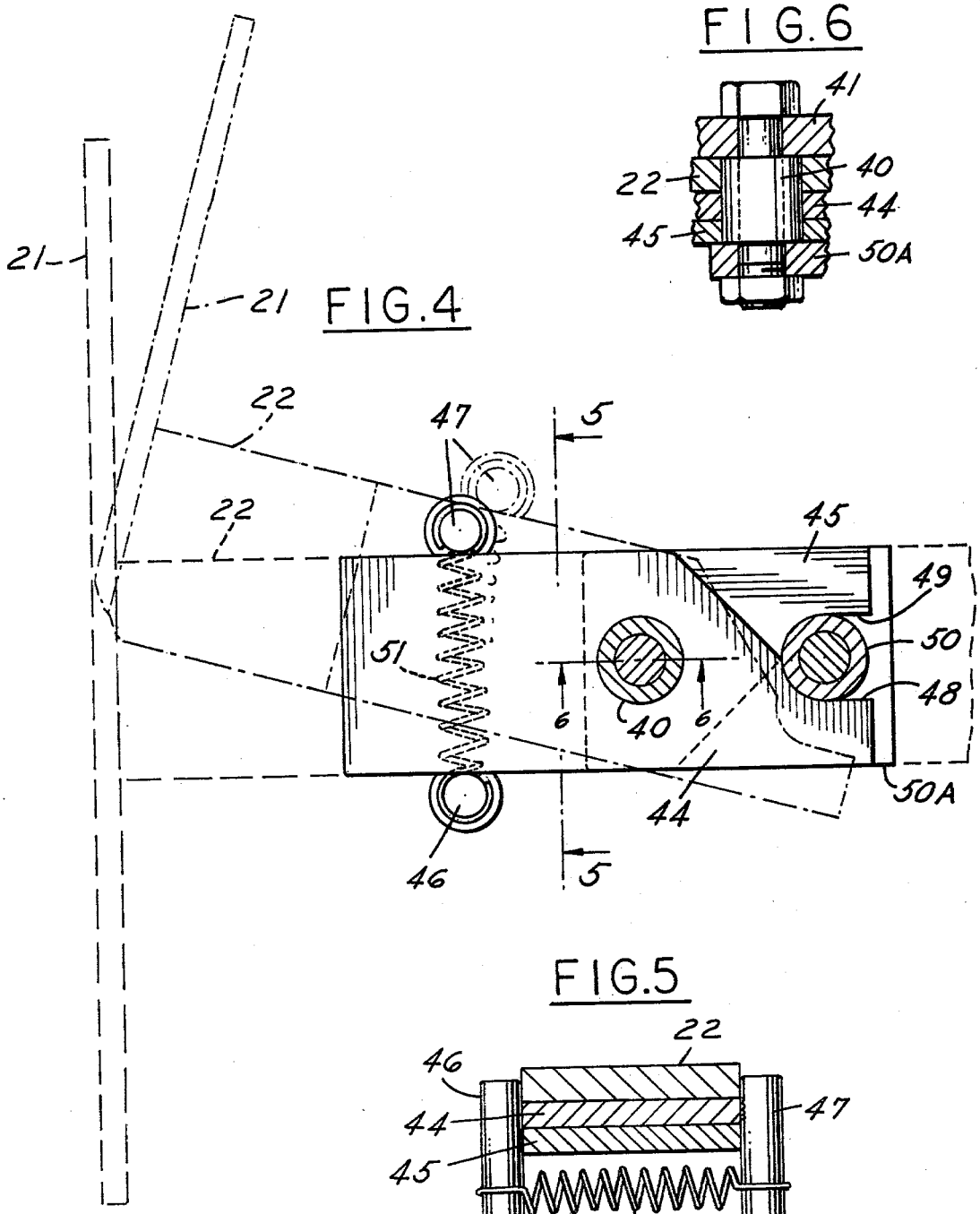
FIG.5
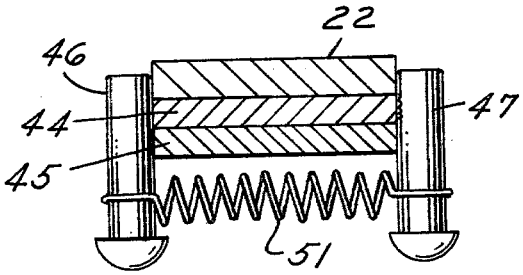

CONVEYOR SYSTEM

This invention relates to conveyor systems and particularly to conveyor systems wherein a motor power unit is adapted to move a load carrier along a track.

BACKGROUND AND SUMMARY OF THE INVENTION

In conveyor systems wherein a motor power unit is provided in an overhead track for moving load carriers along the track, it is common to provide a mechanical coupling such as a tie bar which is manually connected and disconnected to form a coupling between the motor power unit and the load carrier. Such a construction not only has the disadvantage of requiring a manual connection and disconnection but offers problems with backlash and slack.

Accordingly, among the objectives of the present invention are to provide a simple and effective means for connecting and disconnecting the motor power unit and load carrier which can be operated automatically and which will obviate the problems associated with backlash, slack and the like.

In accordance with the invention, a vacuum pad and vacuum power unit are provided on the motor power unit and a plate is provided on the load carrier and is adapted to be engaged by the vacuum pad so that when the vacuum pad engages the plate and is actuated, a coupling is provided between the motor power unit and the load carrier and the motor power unit will move the load carrier along the track, and when the vacuum pad is de-activated, the coupling is automatically disengaged.

DESCRIPTION OF THE DRAWINGS

FIG. 4 is a fragmentary sectional view taken along the line 4—4 in FIG. 1.

FIG. 5 is a fragmentary sectional view taken along the line 5—5 in FIG. 4.

FIG. 6 is a fragmentary sectional view taken along the line 6—6 in FIG. 4.

DESCRIPTION

Figure 1:
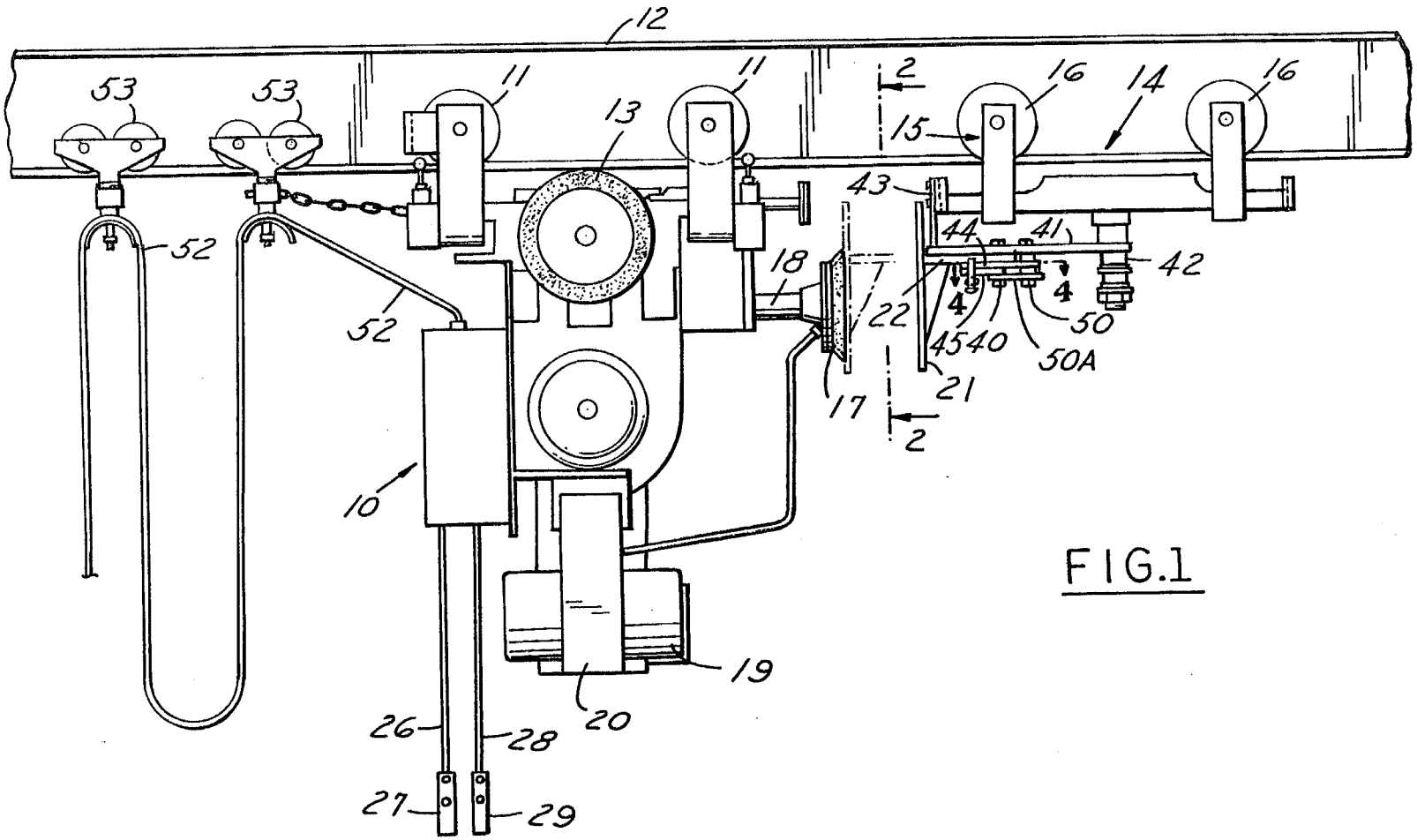
FIG. 1 is a fragmentary side elevational view of a conveyor system embodying the invention.
Figure 2:
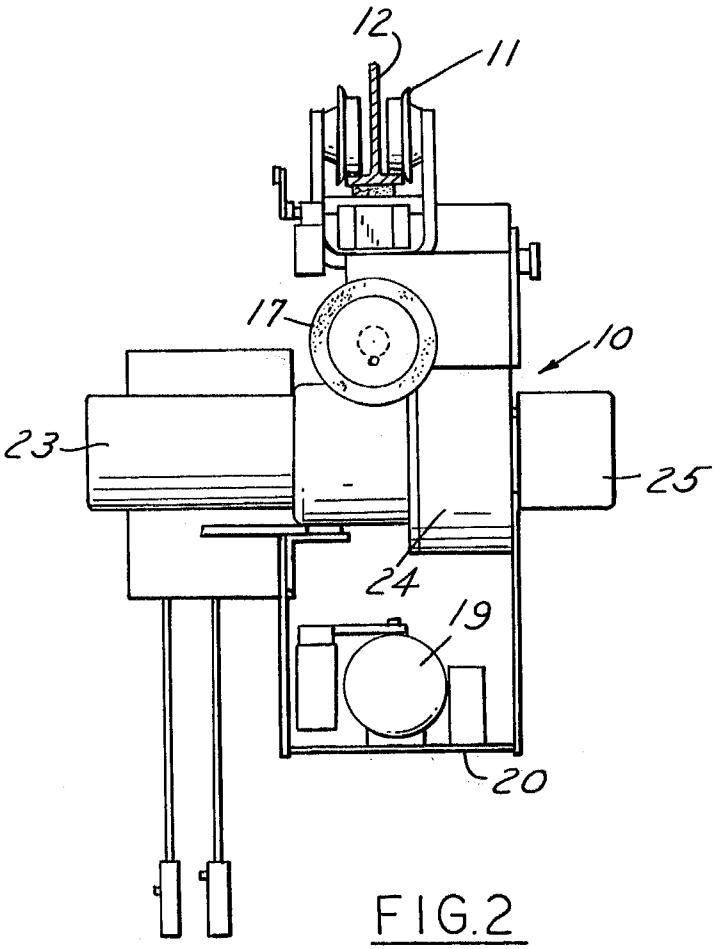
FIG. 2 is a sectional view taken along the line 2—2 in FIG. 1.

Referring to FIGS. 1 and 2, the conveyor system embodying the invention comprises a motor power unit 10 of generally conventional construction having wheels 11 engaging an overhead track 12. The motor power unit 10 includes a drive wheel 13 which is adapted to frictionally engage the track 12 and move the motor power unit along the track as is well known in the art. The conveyor system includes a carrier 14 including one or more load carrying trolleys 15 which may comprise one or more sets of wheels 16 engaging the track and interconnected in accordance with the size of the load to support the load.

In accordance with the invention, a vacuum pad 17 is supported on the motor power unit 10 by a bracket 18 and extends rearwardly with its axis extending horizontally. In addition, a vacuum power unit 19 is supported below the motor power unit 10 by a bracket 20. A vacuum engaging plate 21 is supported on the load carrier and extends forwardly of the trolley with the plane of the plate 21 at a right angle to the axis of the vacuum pad 17 for engagement with the vacuum pad 17.

In order to permit pivotal movement or articulation between the motor power unit 10 and the load carrier 14 when the motor power unit is moved along a curved track, the plate 21 is mounted for pivotal movement about a vertical axis relative to the carrier 14. More specifically, the plate 21 is mounted on a bar 22 that is pivoted by a bolt 40 to a bracket 41 that is fixed on load pin 42 on carrier 14 and fastened by a bar 43 to the front end of the trolley 15. A pair of pivot bars 44, 45 are also pivoted on bolt 40 and have upwardly extending rivets 46, 47 along their edges that normally engage the sides of bar 22. The rear ends of the pivot bars 44, 45 are formed with notches 48, 49 that are adapted to normally engage a second bolt 50 extending downwardly from the bracket 41. A plate **50*a* is interposed between the lowermost bar 45 and the nuts on the bolts 40, 50. A tension spring 51 extends between the rivets 46, 47. By this arrangement, when the vacuum pad 17 is engaged with the plate 21 and the motor power unit moves about a curve in the track, the plate 21 can pivot about the bolt 40 relative to the carrier 14 carrying one of pivot bars 44, 45 with it. The spring 51 returns the plate 21 and the pivot bar 44, 45** which has moved to its original position when the motor power unit moves back to a straight section of the track.

In accordance with conventional construction, the motor power unit 10 includes a motor 23, gearing 24 and a brake 25 to the drive wheel 13. A pendant 26 is suspended from the motor power unit 10 and has the controls 27 for the motor power unit. In addition, an electric cable 52 and associated cable trolleys 53 are provided for applying electric power to the motor power unit 10 and the vacuum power unit 19 as it is moved along the track.

A second pendant 28 is provided on the motor power unit 10 and has the controls 29 for the vacuum power unit 19 turning the vacuum power unit 19 on or off.

Alternatively, the controls may be combined in a single pendant. If the track is provided with conductive power strips, in accordance with well known construction, the motor power unit may receive its power directly by the use of collectors. In such an arrangement, electronic control can be provided to the motor power unit and the vacuum power unit at predetermined pulse along the track.

Figure 3:
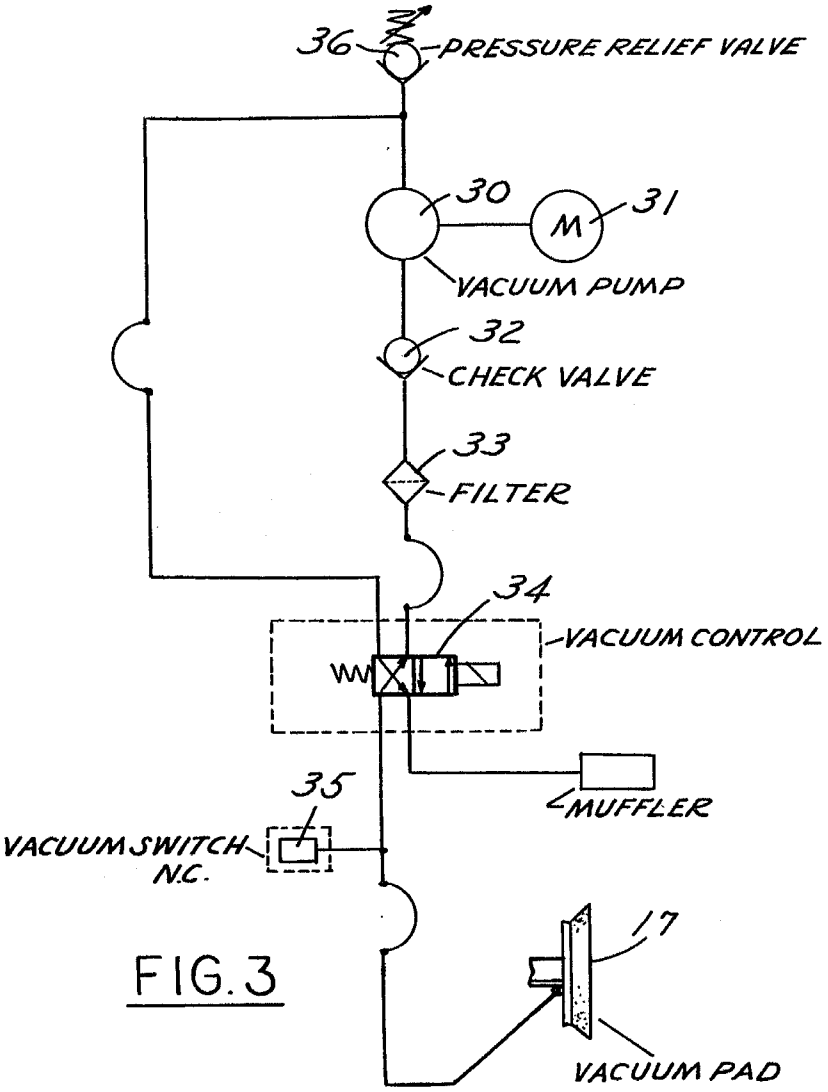
FIG. 3 is a schematic wiring and vacuum diagram of the vacuum pad and vacuum power unit.

As shown in the schematic diagram in FIG. 3, the vacuum power unit 19 for applying vacuum to the vacuum pad 17 comprises a vacuum pump 30 driven by a motor 31 and functions through a check valve 32, filter 33 and vacuum control valve 34 and vacuum switch 35 to apply vacuum to the vacuum pad 17. A pressure relief valve 36 is associated with the vacuum circuit.

In operation, an operator utilizing pendant control 27 moves the motor power unit by energizing drive wheel 13 to bring the motor power unit 10 adjacent the plate 21 of a carrier. Utilizing pendant control 29, vacuum is applied to vacuum pad 17 to engage the plate 21. Then by pendant control 27, the motor power unit 10 and carrier are moved in unison as desired. When the carrier 14 is at the desired destination, pendant control 29 is actuated to de-actuate the vacuum pad 17 automatically disconnecting the carrier 14 from the power unit 10.

We claim:

1. A conveyor system comprising a motor power unit, a load carrier, a track along which said motor power unit and load carrier can move, a vacuum pad mounted on said motor power unit and extending rearwardly, a vacuum power unit on said motor power unit for applying vacuum to said vacuum pad, and a plate extending forwardly of said load carrier and adapted to be engaged by said vacuum pad whereby when said vacuum pad engages said plate and is activated, a coupling is provided between said motor power unit and said load carrier so that the motor power unit will move said load carrier along said track, said vacuum pad having its axis extending longitudinally of said motor power unit and said plate comprising a flat surface at a substantially right angle to the axis of said load carrier, means for mounting said plate for limited pivotal movement about a vertical axis relative to said load carrier, said last-mentioned means comprising a bracket, on which said plate is mounted, pivoted about a vertical axis on said load carrier, and means normally yieldingly urging said plate to a position where its plate is at a right angle to the axis of the load carrier, said last-mentioned means comprising a pair of pivot bars pivoted on the same axis as said bracket and relative to said bracket, spring means yieldingly urging one end of said pivot bars toward one another, each said pivot bar having means thereon engaging said bracket under the action of said spring means, and means on said load carrier limiting the movement of the other ends of said pivot bars toward one another.

2. The conveyor system set forth in claim 1 wherein said means on each pivot bar engaging said bracket comprises a vertical pin.

3. The conveyor system set forth in claim 2 wherein said means limiting the movement of the other ends of said pivot bars comprises a pin on said load carrier, each said pivot bar having a notch on the other end thereof normally engaging said pin.

4. A conveyor system comprising a motor power unit, a load carrier, an overhead track along which said motor power unit and load carrier can move, a vacuum pad mounted on said motor power unit and extending rearwardly, a vacuum power unit on said motor power unit for applying vacuum to said vacuum pad, and a plate extending forwardly of said load carrier and adapted to be engaged by said vacuum pad whereby when said vacuum pad engages said plate and is activated, a coupling is provided between said motor power unit and said load carrier so that the motor power unit will move said load carrier along said track, said vacuum pad having its axis extending longitudinally of said motor power unit and said plate comprising a flat surface at a substantially right angle to the axis of said load carrier, means for mounting said plate for limited pivotal movement about a vertical axis relative to said load carrier, said last-mentioned means comprising a bracket on which said plate is mounted pivoted about a vertical axis on said load carrier, and means normally yieldingly urging said plate to a position where its plane is at a right angle to the axis of the load carrier, said last-mentioned means comprising a pair of pivot bars pivoted on the same axis as said bracket and relative to said bracket, spring means yieldingly urging one end of said pivot bars toward one another, each said pivot bar having means thereon engaging said bracket under the action of said spring means, and means on said load carrier limiting the movement of the other ends of said pivot bars toward one another.

5. The conveyor system as set forth in claim 4 wherein said means on each pivot bar engaging said bracket comprises a vertical pin.

6. The conveyor system set forth in claim 5 wherein said means limiting the movement of the other ends of said pivot bars comprises a pin on said load carrier, each said pivot bar having a notch on the other end thereof normally engaging said pin.

7. For use in a conveyor system, a motor power unit adapted to be moved along a track, a load carrier adapted to be moved along a track, a vacuum pad mounted on said motor power unit adjacent one end thereof and adapted to extend rearwardly when the motor unit is on a track, a vacuum power unit on said motor power unit for applying said vacuum to said vacuum pad, and a plate at one end of said load carrier and adapted to be engaged by said vacuum pad of said motor power unit whereby when said vacuum pad engages said plate and is activated, a coupling is provided between said motor power unit and said load carrier so that the motor power unit will move said load carrier along a track, said vacuum pad having its axis extending longitudinally of said motor power unit and said plate comprising a flat surface at a substantially right angle to the axis of said load carrier, means for mounting said plate for limited pivotal movement about a vertical axis relative to said load carrier, said last-mentioned means comprising a bracket, on which said plate is mounted, pivoted about a vertical axis on said load carrier, and means normally yieldingly urging said plate to a position where its plate is at a right angle to the axis of the load carrier, said last-mentioned means comprising a pair of pivot bars pivoted on the same axis as said bracket and relative to said bracket, spring means yieldingly urging one end of said pivot bars toward one another, each said pivot bar having means thereon engaging said bracket under the action of said spring means, and means on said load carrier limiting the movement of the other ends of said pivot bars toward one another.

8. The conveyor system set forth in claim 7 wherein said means on each pivot bar engaging said bracket comprises a vertical pin.

9. The conveyor system set forth in claim 8 wherein said means limiting the movement of the other ends of said pivot bars comprises a pin on said load carrier, each said pivot bar having a notch on the other end thereof normally engaging said pin.

* * * * *